US011453843B2

(12) United States Patent
Fuentes Ferrando et al.

(10) Patent No.: US 11,453,843 B2
(45) Date of Patent: Sep. 27, 2022

(54) COLOR PROTECTION IN FABRICS USING CITRIC ACID AND IMINODISUCCINATE IN FINE FABRIC LIQUID DETERGENT

(71) Applicant: Colgate-Palmolive Company, New York, NY (US)

(72) Inventors: Hector Fuentes Ferrando, Colonia Jardín Balbuena (MX); Gabriela Perez Castillo, Col. Granada Del Miguel Hidalgo (MX); Vania Celeste Pedroza De Leon, Distrito Federa (MX)

(73) Assignee: Colgate-Palmolive Company, New York, NY (US)

( * ) Notice: Subject to any disclaimer, the term of this patent is extended or adjusted under 35 U.S.C. 154(b) by 109 days.

(21) Appl. No.: 16/469,668

(22) PCT Filed: Dec. 15, 2016

(86) PCT No.: PCT/US2016/067031
§ 371 (c)(1),
(2) Date: Jun. 14, 2019

(87) PCT Pub. No.: WO2018/111285
PCT Pub. Date: Jun. 21, 2018

(65) Prior Publication Data

US 2020/0080028 A1 Mar. 12, 2020

(51) Int. Cl.

| | |
|---|---|
| ***C11D 1/14*** | (2006.01) |
| ***C11D 1/29*** | (2006.01) |
| ***C11D 3/20*** | (2006.01) |
| ***C11D 3/30*** | (2006.01) |
| ***C11D 3/33*** | (2006.01) |
| ***C11D 1/22*** | (2006.01) |
| ***C11D 3/37*** | (2006.01) |
| ***C11D 1/12*** | (2006.01) |

(52) U.S. Cl.
CPC ..... *C11D 3/33* (2013.01); *C11D 1/12* (2013.01); *C11D 1/14* (2013.01); *C11D 1/22* (2013.01); *C11D 1/29* (2013.01); *C11D 3/2082* (2013.01); *C11D 3/2086* (2013.01); *C11D 3/3765* (2013.01)

(58) Field of Classification Search
CPC .... C11D 1/12; C11D 1/14; C11D 1/29; C11D 3/2082; C11D 3/33; C11D 3/3765
USPC ..... 510/357, 477, 488, 475, 499, 505
See application file for complete search history.

(56) References Cited

U.S. PATENT DOCUMENTS

| | | | | |
|---|---|---|---|---|
| 3,697,453 | A | 10/1972 | Tate et al. | |
| 6,627,591 | B2 | 9/2003 | Kuzmenka et al. | |
| 6,870,026 | B1 | 3/2005 | Dean | |
| 8,062,381 | B2 | 11/2011 | Shamayeli et al. | |
| 8,481,474 | B1 | 7/2013 | Hodge | |
| 9,314,651 | B2 * | 4/2016 | Kroepke | A61Q 5/00 |
| 2005/0020478 | A1 | 1/2005 | Finch | |
| 2005/0101505 | A1 | 5/2005 | Wood | |
| 2006/0046946 | A1 * | 3/2006 | van Buskirk | C11D 3/046 510/367 |
| 2010/0017973 | A1 | 1/2010 | Detering et al. | |
| 2010/0093581 | A1 | 4/2010 | Winston et al. | |
| 2011/0201536 | A1 * | 8/2011 | O'Connell | C11D 3/222 510/321 |
| 2012/0100231 | A1 | 4/2012 | Perla et al. | |
| 2014/0100153 | A1 * | 4/2014 | Martinez-Crowley | C11D 3/3953 510/379 |
| 2014/0155312 | A1 * | 6/2014 | Soontravanich | C11D 1/722 510/356 |
| 2014/0317859 | A1 * | 10/2014 | Man | C11D 3/33 8/137 |
| 2015/0105311 | A1 * | 4/2015 | Boutique | C11D 3/2093 510/296 |
| 2015/0247108 | A1 * | 9/2015 | Bettiol | C11D 3/201 510/416 |
| 2017/0191005 | A1 * | 7/2017 | Foverskov | C11D 3/0036 |
| 2017/0335243 | A1 * | 11/2017 | Hansen | C11D 3/044 |
| 2018/0016523 | A1 * | 1/2018 | Coope Epstein | C11D 1/831 |
| 2019/0177665 | A1 * | 6/2019 | Spangenberg | C11D 11/0017 |

FOREIGN PATENT DOCUMENTS

| | | |
|---|---|---|
| EP | 2083065 | 7/2009 |
| WO | 2000/034427 | 6/2000 |

OTHER PUBLICATIONS

Rohm and Haas, Acusol Opacifier; Acusol OP 301, p. 1-2, 2001. (Year: 2001).*
International Search Report and Written Opinion of the International Searching Authority in International Application No. PCT/US2016/067031, dated Feb. 6, 2017.

* cited by examiner

*Primary Examiner* — Gregory R Delcotto

(57) ABSTRACT

Provided is a liquid detergent that includes a liquid carrier, at least one surfactant, such as at least one anionic surfactant, and at least two chelating agents. A first of the two chelating agents includes citric acid monohydrate. A second of the two chelating agents includes iminodisuccinic acid. A use of the liquid detergent composition for the washing of fabrics. A method of making a cleaning composition comprising combining a liquid carrier, at least one surfactant, and at least two chelating agents, wherein a first of the two chelating agents comprises citric acid monohydrate and a second of the two chelating agents comprises iminodisuccinic acid.

10 Claims, No Drawings

COLOR PROTECTION IN FABRICS USING CITRIC ACID AND IMINODISUCCINATE IN FINE FABRIC LIQUID DETERGENT

BACKGROUND

This invention relates to liquid laundry detergent compositions. More particularly, it relates to a laundry composition capable of providing improved color protection of delicate fabrics during machine or hand washing.

Detergent compositions which are specially formulated as fine fabric compositions to refresh the fabric and remove light soils are known in the art. It has been recognized that for purposes of protecting fine fabrics from fiber damage resulting from agitation in a wash bath, the presence of foam or suds may have a beneficial effect insofar as it creates a type of air cushion which surrounds the fabric and protects it from undue friction during laundering. For sensitive and delicate fabrics such as wool and silk, such fiber protection is particularly important. Anionic surfactants are known to generate foam primarily upon mechanical agitation of the wash bath during laundering, either by machine or by hand washing. However, in certain regions where hard water conditions exist, anionic surfactants can interact with the cationic metal ions of local water supplies. Meanwhile, chelants (sometimes referred to as sequestrants, chelating agents or quelants) are a specialized molecules designed to bind to positively charged metal ions. Most commonly, chelants bind to calcium and magnesium in solution, although they can also bind with any metal ions in solution, including iron and manganese. Further, chelants are effective in removing some stains because they bind to and remove the metal ions that help crosslink and stabilize most stain structures. Once the metal ions are removed, the remainder of the stain becomes much easier to break apart and/or remove from fabrics. Accordingly, detergent compositions can be adapted for use over a wide range of pH and may generally be formulated using, among other components, anionic surfactants and chelants.

Meanwhile, many fabrics are dyed using metal complex dyes that include metal ions. As a result of cleaning such fabrics with detergent compositions that include a chelating agent, dyed fabrics suffer from fading. For example, the dye itself becomes discolored because of the loss of metal ions that bind to the chelating agent. It has been found that certain chelating agents such as ethylenediaminetetraacetic acid (EDTA) and amino trimethyl phosphonic acid (ATPA) suppress the degradation of dyed fabric. However, as the industry trends away from these chelating agents, detergents that provide better color protection but are also effective at breaking apart stains are needed in the art.

BRIEF SUMMARY

The present disclosure is directed to a liquid detergent composition, comprising: a liquid carrier; at least one surfactant; and at least one chelating agents, wherein a first of the two chelating agents comprises citric acid monohydrate and a second of the two chelating agents comprises iminodisuccinic acid.

In one embodiment of the liquid detergent, the two or more chelating agents do not comprise aminotrimethylphosphonic acid.

In any one of these embodiments of the liquid detergent, the two or more chelating agents do not comprise ethylenediaminetetraacetic acid (EDTA) or its salts.

In any one of these embodiments of the liquid detergent, the citric acid monohydrate is present in an amount by weight greater than an amount of the iminodisuccinic acid by weight.

In any one of these embodiments of the liquid detergent, the citric acid monohydrate is present in an amount of from greater than about 0% to about 0.24% by weight.

In any one of the embodiments of the liquid detergent, the iminodisuccinic acid is present in an amount of from greater than about 0% to about 0.4% by weight.

In any one of these embodiments of a liquid detergent, the surfactant comprises an anionic surfactant.

In any one of these embodiments of the liquid detergent, the at least one surfactant comprises sodium lauryl (LAS), sodium lauryl ether sulfate (SLES), or combinations thereof.

In any one of these embodiments of the liquid detergent, the liquid detergent further comprises at least one C12-C14 alcohol ethoxylates sulfate.

In any one of these embodiments of the liquid detergent, the liquid detergent further comprises at least one anti-ashing polymer, copolymer or mixtures thereof.

In any one of these embodiments of the liquid detergent, the liquid detergent further comprises an anti-ashing copolymer comprising styrene/acrylic copolymer.

In any one of these embodiments of the liquid detergent, the liquid carrier comprises softened water and demineralized water.

One implementation includes a use of the liquid detergent composition of any one of these embodiments of the liquid detergent In an embodiment there is a method of making a cleaning composition comprising combining the following: a liquid carrier; at least one surfactant; and at least two chelating agents, wherein a first of the two chelating agents comprises citric acid monohydrate and a second of the two chelating agents comprises iminodisuccinic acid.

In the embodiment of the method of making the cleaning composition, the two or more chelating agents do not comprise aminotrimethylphosphonic acid, ethylenediaminetetraacetic acid (EDTA) or salts thereof In these embodiments of the method of making the cleaning composition, the citric acid monohydrate is present in an amount by weight greater than an amount of the iminodisuccinic acid by weight.

In these embodiments of the method of making the cleaning composition, the citric acid monohydrate is present in an amount of from greater than about 0% to about 0.24% by weight.

In these embodiments of the method of making the cleaning composition, the iminodisuccinic acid is present in an amount of from greater than about 0% to about 0.4% by weight.

In these embodiments of the method of making the cleaning composition, the surfactant comprises an anionic surfactant.

Further areas of applicability of the present invention will become apparent from the detailed description provided hereinafter. It should be understood that the detailed description and specific examples, while indicating some preferred aspects of the invention, are intended for purposes of illustration only and are not intended to limit the scope of the invention.

DETAILED DESCRIPTION

The following description of various preferred aspect(s) is merely exemplary in nature and is in no way intended to limit the invention, its application, or uses.

As used throughout, ranges are used as shorthand for describing each and every value that is within the range, including endpoints. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material as compared to the total weight of the composition.

Implementations described herein provide for a detergent. The detergent compositions of may be in liquid form, for example, as a liquid detergent, such as a fine fabric liquid detergent that provides enhanced color protection to fabrics. In at least one implementation, the liquid detergent includes a liquid carrier, at least one surfactant, such as at least one anionic surfactant, and at least two chelating agents, wherein a first of the two chelating agents comprises citric acid monohydrate and a second of the two chelating agents comprises iminodisuccinic acid.

To prepare a cleaning composition, such as the liquid detergent described above, at least one surfactant, such as the at least one anionic surfactant, and the at least two chelating agents are incorporated into a liquid carrier. For example, the at least one surfactant, the at least one anionic surfactant, a first of the two chelating agents comprising citric acid monohydrate, and a second of the two chelating agents comprises iminodisuccinic acid, may be incorporated into the liquid carrier.

The liquid carrier for the liquid compositions of this invention is preferably water alone, but an aqueous carrier containing minor amounts of additional components, such as at least one alcohol, may also be used in some cases. Generally, water may be provided in an amount of about from about 50% to about 90%, for example, from about 80% to about 90%, preferably from about 82% to 90%, by weight of the composition. The water may be deionized, softened and/or demineralized, but tap water may also be sufficient. In an embodiment, water that is both demineralized and softened may be used. In an embodiment, dissolved minerals may such as Softened Water The viscosity of the liquid detergent is normally in the range of from about 30 to 1000 centipoises, for example, from about 400 to 1000 centipoises, preferably from about 400 to 800 centipoises, but products of other suitable viscosities may also be useful. At the viscosities mentioned, the liquid detergent is pourable, stable, non-separating and uniform.

Anionic Surfactant

In at least one implementation, the liquid detergent composition comprises at least one anionic surfactant. Preferably, the at least one anionic surfactant may be chosen from sodium lauryl sulfate (LAS), sodium lauryl ether sulfate (SLES), or mixtures thereof In an implementation, anionic surfactant is present in an amount of about from about 8.0% to about 13%, for example, from about 9% to about 12%, preferably from about 9.1% to 10.1%, by weight of the composition.

Chelating Agent

In at least one implementation, the liquid detergent composition may include at least two chelating agents. Suitable chelating agents are capable of chelating metal ions and are present in a total amount of preferably from about greater than 0% to about 0.64%, including from about 0.05% to about 0.225%, and more preferably about 0.06% to about 0.113%, for example, at least about 0.112% by weight of the liquid detergent composition. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among citric acid (e.g., anhydrous) and iminodisuccinic acid (available as BAYPURE® CX100 from Lanxess Chemical Company of Cologne, Germany). Exemplary ones of the at least two chelating agents include a first and a second of the two chelating agents. Ethylenediaminetetraacetic acid (EDTA) is a known non-biodegradable chelants and poses environmental concerns, thus the at least two chelating agents preferably do not comprise EDTA. Preferably the first of the two chelating agents comprises citric acid monohydrate and a second of the two chelating agents comprises iminodisuccinic acid.

Optional Ingredients

In at least on implementation, the liquid detergent composition may further include one or more of optional ingredients. Examples of optional components that may be useful for the present implementations include, but are not limited to: anionic surfactants, nonionic surfactants, fragrances, colorants, optical brighteners, antibacterial agents/preservatives, and anti-ashing polymers, copolymers, salts, silicons pearlescent agents, color protection agent.

Non-Ionic Surfactant

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foaming agents. Consequently, for detergents which require copious and stable foam, the use of nonionic surfactants is limited.

The nonionic surfactant can be any nonionic surfactant known in the art of aqueous surfactant compositions. Suitable nonionic surfactants include but are not limited to aliphatic ($C_6$-$C_{18}$) primary or secondary linear or branched chain acids, alcohols or phenols, alkyl ethoxylates, alkyl phenol alkoxylates (especially ethoxylates and mixed ethoxy/propoxy), block alkylene oxide condensate of alkyl phenols, alkylene oxide condensates of alkanols, ethylene oxide/propylene oxide block copolymers, semi-polar nonionics (e.g., amine oxides and phospine oxides), as well as alkyl amine oxides. Other suitable nonionics include mono or di alkyl alkanolamides and alkyl polysaccharides, sorbitan fatty acid esters, polyoxyethylene sorbitan fatty acid esters, polyoxyethylene sorbitol esters, polyoxyethylene acids, and polyoxyethylene alcohols. Examples of suitable nonionic surfactants include coco mono or diethanolamide, coco diglucoside, alkyl polyglucoside, cocamidopropyl and lauramine oxide, polysorbate 20, ethoxylated linear alcohols, cetearyl alcohol, lanolin alcohol, stearic acid, glyceryl stearate, PEG-100 stearate, and oleth 20.

In certain implementations, the compositions of the present invention may include one or more alkyl ethoxylated ether sulfates. In an implementation, the non-ionic surfactant comprises a $C_{12}$-$C_{14}$ alcohol ethoxylate and a $C_{12}$-$C_{14}$ alcohol ethoxylates sulfate.

The nonionic surfactant may present in a total amount of at least 0.35%, preferably from 0.1% to 0.35%, and more preferably 0.25% to 0.3%, by weight of the liquid detergent composition.

Other anionic surfactants may include lauryl myristyl amidopropyl dimethylamine oxide (LMDO) (available from BASF Corporation of Florham Park, N.J., also available as OXIDET® L-75 CP or AMMONYX® LMDO from and Kao Corporation). The anionic surfactant may present in a total amount of at least 0.7%, preferably from 0.06% to 0.07%, by weight of the liquid detergent composition.

Fragrance

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances. Such fragrances are available from International Flavors and Fragrances, Inc., the Colgate-Palmolive Company, and Givaudan, for instance.

Colorant

In at least one implementation, the liquid detergent composition may include one or more colorant. The one or more colorant may be at least one pigment and/or at least one dye. Pigments include nontoxic, water insoluble inorganic pigments such as titanium dioxide and chromium oxide. The liquid detergent composition may contain colorants in liquid and powder, and are present at a concentration of from 0.15% to about 0.30%, such as from about 0.18% to about 0.27%, for example, from about 0.20% to about 0.25% by weight.

Dyes generally include natural dyes from plant sources or synthetic resources such as petroleum by-products. The liquid detergent comprises a dye colorant comprising Acid Red 52 (C.I. 45100), Acid Yellow 17 (C.I. 18965), or both, also liquid detergent may contains Liquitint Red MX, Liquid Violet LS, Liquitint Bright Yellow. Liquitint Green Fs and Liquitint Yellow LP. Preferred colorants are CI Acid Red 52 and CI Acid Yellow 17.

In various implementations, the concentration of the dye in the liquid detergent composition is in an amount of from about 0.00004% to about 3%, such as from about 0.000050% to about 0.003%, for example, from about 0.000055% to about 0.0024% by weight. Exemplary ranges of the colorants presented in formulas are presented as follows: CI Acid Red 52 from 0.00005% to 0.0003%; CI ACID YELLOW 17 (CI 18965), 0.00030% to 0.00040%; Liquitint Yellow LP from 0.00005% to 0.00010%; Liquitint Bright Yellow, 0.0020% to 0.0030%; Liquitint Green FS, 0.00005% to 0.0002%; Liquitint Red MX, 0.00040% to 0.00050%; and Liquitint Violet LS, 0.00010% to 0.00020%

Optical Brightener

In at least one implementation, the composition includes at least one optical brightener. While not limited to any particular function, the optical brightener may be utilized in the liquid detergent composition to improve whitening on clothes when drying on sun. In an example, the liquid detergent comprises an optical brightener Tinopal CBS-SP 30% (available from Dow Chemical).

In various implementations, the concentration of the optical brightener in the liquid detergent composition is in an amount of from about 0.01% to about 0.15%, such as from about 0.02% to about 0.10%, for example, from about 0.04% to about 0.09 by weight.

Anti-Ashing Polymers

In at least one implementation, the composition includes at least one Anti-Ashing polymer. In an example, the anti-ashing polymer may be a styrene/acrylic Copolymer (e.g., ACUSOLTM OP 301 emulsion from Dow Chemical) is in formula, and is present at a concentration of from about 0.01% to about 0.20%, such as from about 0.05% to about 0.15%, for example, from about 0.05% to about 0.01% by weight.

Preservative/Bacteriocide

Optionally, a soluble preservative may be added to compositions of the present invention. In one implementation, the preservative is a broad-spectrum preservative, which controls the growth of bacteria and fungi. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

Biocidal materials may be optionally added to the compositions of the present invention. As used herein, "biocidal materials" refer to substances that kill or destroy bacteria or fungi, and/or regulate or retard the growth of microorganisms. As used herein, biocidal materials may include, for example, antibacterial compositions, antiviral compositions and compositions such as such as biostatic preservatives.

pH Modifiers

As necessary, pH modifiers, such as water soluble bases, e.g., NaOH, KOH, amines, or ammonia, may be added to the detergent composition in order to obtain the desired pH level in the washing bath. The preferred wash water pH will range from about 3 up to less than 6, for example, from about 3.5 up to 5.5 and most preferably from about 4.3 up to 4.7. Where the detergent composition is in the form of a liquid, the liquid will exhibit a pH within the range of about 3.5 to about 5.5.

Methods

In some implementations, the present disclosure provides methods to clean fabrics using a liquid detergent composition that includes a liquid carrier, at least one surfactant, such as at least one anionic surfactant and at least two chelating agents, wherein a first of the two chelating agents comprises citric acid monohydrate and a second of the two chelating agents comprises iminodisuccinic acid. The method may include incorporating the liquid detergent during general washing conditions, such as during laundering, either by machine or by hand washing.

It is noted that although various implementations have been described separately, features from one implementation may be used with other implementations.

EXAMPLES

Example 1—Preparation of Liquid Detergent Compositions

Various liquid detergent compositions, according to at least one embodiment described herein, were prepared. An exemplary composition ("prototype 4") was prepared by combining the ingredients listed in and in the amounts set forth in Table 1 below.

Generally, the compositions can be prepared at room temperature. Active ingredients and neutralization were added into a stainless vessel first, followed by addition of other ingredients, including the fragrance and colors. Viscosity and pH adjustments were made as needed.

The liquid detergent composition of the invention may be prepared as a liquid composition. First, water may be added at room temperature, more preferably about 20° C. to about 25° C. Sulphonic acid was then added and neutralized with sodium hydroxide while the liquid composition may be agitated at about 200-1,000 rpm, preferably about 500-800 rpm, for about 2-10 minutes, preferably for about 3-5 minutes. To the agitated liquid composition, the rest of the active ingredients from Table 1 below may be added until full dispersion for about 10-20 min more preferably 15-18 min. The acid agent(s), chelant agent(s), and/or preservative agent(s) may also be added, keeping the agitation at about 200-1,000 rpm, preferably about 500-800 rpm, for about 3-15 minutes, preferably about 5-10 minutes. The combination of optional fragrance oils and/or fragrance capsules may be added at an agitation of about 200-1,000 rpm, preferably about 500-800 rpm, for about 2-10 minutes, preferably for about 3-5 minutes and finally salt is added to adjust viscosity at about 200-1,000 rpm, preferably about 500-800 rpm, for about 2-10 minutes, preferably for about 3-5 minutes. Meanwhile viscosity may be monitored in order that the final formulation meets predetermined specifications. It is noted that agitation provides a shear force that distributes the solids in the composition. However, in alternative embodiment, the shear force may be achieved using a system with standard baffling or static mixers. For example, standard baffling consist of four flat vertical plates, radially-directed (i.e., normal to the vessel wall), spaced at 90 degrees around the vessel periphery, and running the length of the vessel's straight side; standard baffle width is 1/10 or 1/12 of the vessel diameter (T/10 or T/12).

TABLE 1

| Ingredient | % |
|---|---|
| WATER | 65.2555 |
| SULPHONIC ACID | 1.9500 |
| DETERGENT | |
| CAUSTIC SODA | 0.5500 |
| SURFACTANT | 27.5862 |
| EMULSIFIER | 0.3000 |
| ANTIMICROBIAL | 0.2500 |
| MICROBICIDE | 0.0200 |
| OPTICAL BRIGHTENER | 0.1727 |
| OPACIFIER | 0.2500 |
| FRAGRANCE | 0.3500 |
| DYES | 0.0006 |
| CITRIC ACID MONOHYDRATE | 0.0600 |
| IMINODISUCCINATE | 0.1550 |
| RHEOLOGY MODIFIER | 3.1000 |
| TOTAL | 100.0000 |

Example 2—Chelating Agent Concentration

Four additional liquid detergent compositions (Prototypes 1-3 and 5) were prepared according to the method described in Example 1 above but with each composition comprising different amounts of iminodisuccinate acid and/or citric acid. A comparative formulation similar to that in Table 1 except not comprising iminodisuccinate acid or citric acid but instead comprising EDTA and DEQUEST® (Available from Italmatch Chemicals of Red Bank, N.J.) was prepared as prototype 6. The resulting chelating agent concentrations of each liquid detergent composition of prototypes 1-6 are shown in Table 2.

TABLE 2

| Prototype | Iminodisuccinate Acid (w/w %) | Citric Acid (w/w %) | EDTA (w/w %) | DEQUEST ® (w/w %) |
|---|---|---|---|---|
| 1 | 0.155 | 0.12 | 0 | 0 |
| 2 | 0.31 | 0.06 | 0 | 0 |
| 3 | 0 | 0.06 | 0 | 0 |
| 4 | 0.155 | 0.06 | 0 | 0 |
| 5 | 0.155 | 0 | 0 | 0 |
| 6 (Comparative) | 0 | 0 | 0.16 | 0.4 |

Example 3—Detergency

Stain removal properties of the detergents protoypes 1-5 along with above were evaluated using demineralized and softened water having a maximum of total dissolved solids of 1000 mg/L and hardness of 10 mg/L. Performance of the detergents was evaluated in the presence/absence of dissolved minerals (Arsenic, Copper, Iron, Calcium, Magnesium, Sulfates, etc.) where the concentration depended as a result of processing, such as distillation, deionization, membrane filtration (reverse osmosis or nano-filtration), electrodialysis or other technologies.

The conventional formulation was also evaluated as a comparative example. Four types of stains including were prepared on different fabrics. The stain types included oxidative, enzymatic, particulate and oleos. The fabric types included cotton, polyester, wool, rayon, nylon, nylon & lycra, polyester, and polyester lycra & cotton. After the stains were prepared, each of the fabrics was washed. The conditions for the wash included water at 150 ppm, 2.5kg of fabric load, one wash cycle and at room temperature.

The sample swatches of fabric were stitched in linen fabric. The test was conducted in triplicate. Comparative swatches with no stains and those swatches that were stained were measured in Hunter Lab L*a*b equipment in order to obtain quantitative values for the color spectrum. After washing the samples, the amount of the stain removed was calculated (shown as amount removed in % in Table 3). The results of these calculations are shown in Table 3 below.

TABLE 3

| ID | Artificial Perspiration (%) | Chocolate Ice cream (%) | Red wine (%) | Cosmetic Makeup/ Nylon (%) | Olive Oil (%) | Cosmetic Makeup/ Nylon/lycra (%) | Blood, Milk & Ink (%) | Coffee (%) | Avg. (%) |
|---|---|---|---|---|---|---|---|---|---|
| Water | 59.90 | 83.68 | 48.60 | 82.41 | −10.94 | 57.83 | 17.29 | 58.59 | 49.67 |
| Prototype 1 | 68.31 | 95.63 | 51.32 | 95.15 | 9.10 | 88.15 | 20.96 | 63.68 | 61.54 |
| Prototype 2 | 71.69 | 95.31 | 53.11 | 92.50 | 23.35 | 84.22 | 23.51 | 61.16 | 63.11 |
| Prototype 3 ( | 62.22 | 92.07 | 51.46 | 86.20 | 21.80 | 74.80 | 20.77 | 60.19 | 58.69 |
| Prototype 4 | 52.17 | 95.38 | 53.91 | 97.48 | 42.58 | 84.83 | 22.45 | 64.85 | 64.21 |
| Prototype 5 | 78.84 | 96.24 | 57.11 | 94.45 | 41.99 | 84.38 | 21.30 | 62.99 | 67.17 |

TABLE 3-continued

| ID | Artificial Perspiration (%) | Chocolate Ice cream (%) | Red wine (%) | Cosmetic Makeup/ Nylon (%) | Olive Oil (%) | Cosmetic Makeup/ Nylon/lycra (%) | Blood, Milk & Ink (%) | Coffee (%) | Avg. (%) |
|---|---|---|---|---|---|---|---|---|---|
| Prototype 6 (Comparative) | 80.19 | 96.11 | 53.59 | 89.32 | 36.12 | 77.34 | 20.04 | 64.37 | 64.64 |

As seen in Table 3, there is a tendency toward improvement in stain removal as the amount of iminodisuccinate acid ("imino") is increased across the different liquid detergent formulations. For example, in Table 3 above, prototype 3 (0% imino; 0.06% citric acid) showed an average of 58.69% stain removal, prototype 1 (0.155% imino; 0.12% citric acid) showed an average of 61.54% stain removal and prototype 2 (0.31% imino; 0.06% citric acid) showed an average of 63.11% stain removal.

Example 4—Color Protection

Color protection properties of the detergents of prototypes 1- were evaluated. An additional formulation similar to prototype 1 except comprising 0.21 w/w% iminodisuccinic acid and 0.03 w/w % citric acid, which was determined by a DOE statistical analysis, was prepared as prototype 7. A conventional formulation (shown as prototype "water" in Table 4, and a Standard Detergent without optical brightener (listed as prototype "wob") that is used in AATCC Test Methods was also evaluated as a comparative example.

To evaluate color protection, three different fabrics (cotton, polyester and nylon) at different colors each (blue and pink) were each washed with the different liquid detergent formulations. The same was done with the conventional detergent, the standardized detergent without brightener and water. Each of the fabrics was washed together in a tergotometer with a respective one of a multifiber fabric. After each wash, the multifiber fabric was inspected. Each multifiber fabric was scored based on initial and final values of reflectivity as measured by Hunter L,a,b equipment. The resulting transfer grade scores for each of the mediums are shown in Table 4 below.

TABLE 4

| Prototype | Sum of Transfer Grade* |
|---|---|
| Water | 62 |
| 1 | 82 |
| 2 | 80 |
| 3 | 72 |
| 4 | 86 |
| 5 | 72 |
| 6 | 63 |
| 7 | 77 |
| wob | 67 |

*Higher value = better performance for color protection

Based on the transfer grade results, it was determined that the liquid detergent composition of Example 1 (prototype 4) performed better than the other compositions at protecting the color of the colored samples and prevented the most amount of color transfer to the multifiber fabric during a wash cycle due to the unexpected synergy between iminodisuccinate and citric acid in some liquid detergent compositions. In light of the results shown in Tables 3 and 4 for prototypes 1, 2, 4 and 7 there is an unexpected jump in overall improvement—that is, detergency and color protection considered together—for the formulations that combine the increased amount of iminodisuccinate with certain volumes of citric acid according to compositions described herein.

What is claimed is:

1. A liquid detergent composition, comprising:

a liquid carrier;

at least one anionic surfactant;

at least one anti-ashing polymer, copolymer or mixtures thereof present at a concentration of from about 0.01% to about 0.20% by weight; and at least two chelating agents, wherein a first of the two chelating agents comprises citric acid monohydrate and a second of the two chelating agents comprises iminodisuccinic acid, wherein the citric acid monohydrate is present in an amount of from 0.03% to 0.06% by weight, and wherein the iminodisuccinic acid is present in an amount of from 0.155% to 0.31% by weight.

2. The liquid detergent of claim 1, wherein the at least two chelating agents do not comprise aminotrimethylphosphonic acid.

3. The liquid detergent of claim 1, wherein the at least two chelating agents do not comprise ethylenediaminetetraacetic acid (EDTA) or its salts.

4. The liquid detergent of claim 1, wherein the citric acid monohydrate is present in an amount of 0.06% by weight, and wherein the iminodisuccinic acid is present in an amount of 0.155% by weight.

5. The liquid detergent of claim 1, wherein the at least one anionic surfactant comprises sodium lauryl sulfate (LAS), sodium lauryl ether sulfate (SLES), or combinations thereof.

6. The liquid detergent of claim 1, wherein the at least one anionic surfactant comprises a $C_{12}$-$C_{14}$ alcohol ethoxylate sulfate.

7. The liquid detergent of claim 1, wherein said at least one anti-ashing polymer, copolymer or mixtures thereof is present at a concentration of from about 0.05% to about 0.15% by weight.

8. The liquid detergent of claim 1, wherein said at least one anti-ashing polymer, copolymer or mixtures thereof comprises styrene/acrylic copolymer.

9. The liquid detergent of claim 1, wherein the liquid carrier comprises softened water and demineralized water.

10. A method of washing fabrics, said method comprising contacting said fabrics with the composition of claim 1.

* * * * *